United States Patent [19]

Diesch

[11] 4,391,082

[45] Jul. 5, 1983

[54] SLIDE MOUNTER WITH FILM CURL ACCOMMODATOR

[75] Inventor: Robert E. Diesch, Rogers, Minn.

[73] Assignee: Pako Corporation, Minneapolis, Minn.

[21] Appl. No.: 204,555

[22] Filed: Nov. 6, 1980

[51] Int. Cl.[3] ..... B65B 61/00; B65B 63/00

[52] U.S. Cl. ..... 53/520; 53/250; 53/266 R

[58] Field of Search ..... 53/520, 249, 250, 266 A, 53/266 C, 266 R

[56] References Cited

U.S. PATENT DOCUMENTS

| | | | |
|---|---|---|---|
| 3,341,960 | 9/1967 | Florjancic et al. | 40/152 |
| 3,470,642 | 10/1969 | Mundt et al. | 40/152 |
| 3,478,456 | 11/1969 | Mundt et al. | 40/152 |
| 3,524,299 | 8/1970 | Mundt et al. | 53/23 |
| 3,562,074 | 2/1971 | Mundt et al. | 156/580 |
| 3,570,342 | 3/1971 | Mundt | 83/90 |
| 3,614,854 | 10/1971 | Mundt et al. | 53/381 R |
| 3,788,031 | 1/1974 | Florjancic | 53/252 |
| 3,807,121 | 4/1974 | Mundt et al. | 53/35 |
| 3,943,029 | 3/1976 | Mundt et al. | 156/572 |
| 3,977,280 | 8/1976 | Mundt et al. | |
| 4,004,340 | 1/1977 | Urban | 29/417 |
| 4,135,343 | 1/1979 | Urban et al. | 156/108 |
| 4,237,678 | 12/1980 | Thompson | 53/520 |
| 4,331,260 | 5/1982 | Eutenever et al. | 53/520 X |

OTHER PUBLICATIONS

Pako Corp. Drawing, "Curl Roller Kit," Part Number 509-18031, Sep. 1978.

Pako Corp. Drawing, "Curl Roller Kit," Part Number 509-18031, Sep. 1978.

Pako Corp. Drawing, "Roller-Guide Curl," Part Number 509-2084, Mar. 1974.

Pako Corp. Drawing, "O-Ring," Part Number R-50, Oct. 1981.

"Operating Instructions for Semi-Automatic Mounters; Types 6001 and 7004", Aug. 1977.

Catalog sheet entitled, "Pako Consumer Slide Mounting Kits", Pako Corporation, dated 8-75.

Brochure, entitled, "Pakon Mount System/Pako", Pako Corporation, dated 6/79.

*Primary Examiner*—Nicholas P. Godici

*Assistant Examiner*—Charles L. Willis

*Attorney, Agent, or Firm*—Kinney, Lange, Braddock, Westman and Fairbairn

[57] ABSTRACT

A photographic slide mounter cuts photographic film transparencies from a photographic film web and inserts the transparencies into slide frames. The slide mounter includes a slide advance device which advances a slide frame to a position where the slide frame is flexed to provide an insertion opening. The film web is advanced into the insertion opening until a leading end of the film is partially inserted into the slide frame. A knife severs a transparency at a position outside of the slide frame. The slide frame with the partially inserted transparency is then advanced along a track away from the film severing and insertion station. The film transparency is engaged and fully inserted into the slide frame as the slide frame and the transparency are fed along the track. A film curl accommodator bends the slide frame by an amount sufficient to match the curl or bow of the transparency as the transparency is being fully inserted into the slide frame.

16 Claims, 7 Drawing Figures

SLIDE MOUNTER WITH FILM CURL ACCOMMODATOR

BACKGROUND OF THE INVENTION

1. Field of the Invention

The present invention relates to photographic slide mounting apparatus.

2. Description of the Prior Art

Photographic slides are produced by mounting a photographic film transparency in a slide mount frame so that the image of the photographic transparency is aligned with the aperture of the frame. A variety of different types of mounting frames and mounting apparatus have been developed.

One particularly advantageous type of photographic slide mount is the Pakon slide mount, which is a one-piece plastic slide mount sold by Pako Corporation, the assignee of the present application. The film transparency is mounted by opening a film insertion slot in the slide mount by means of mounting equipment. The transparency slides into the mount and the mount is closed. The spring-like properties of the plastic slide mount material provides a safe and tight fit of the transparency in the slide mount without the need of welding or sealing.

U.S. patents showing slide mounts and slide mounting apparatus of this general type include the following patents:

Florjancic et al.—U.S. Pat. No. 3,341,960
Mundt et al.—3,470,642
Mundt et al.—3,478,456
Mundt et al.—3,524,299
Mundt et al.—3,562,074
Mundt—3,570,342
Mundt et al.—3,614,854
Florjancic 3,788,031
Mundt et al.—3,807,121
Mundt et al.—3,943,029
Mundt et al.—3,977,280
Urban—4,004,340
Urban et al.—4,135,343

Automatic and semi-automatic slide mounters have been developed for mounting photographic film transparencies in Pakon slide mounts. In general, these slide mounters perform five functions. First, the slide mount is flexed to widen an insertion slot in the slide mount. Second, a film web is advanced and partially inserted through the insertion slot into the mount. Third, the transparency is severed from the remainder of the film web. Fourth, the transparency is inserted completely into the slide mount. Fifth, the mounter ejects the mounted slide.

The Mundt et al. U.S. Pat. Nos. 3,614,854 and 3,807,121 show apparatus which perform these functions. In the Mundt et al patents, a gripper grips the severed transparency and pulls the transparency into the mount to complete the insertion of the transparency into the mount.

In the Urban et al. U.S. Pat. No. 4,135,343 a guide rail is provided which engages the trailing end of the severed transparency to insert the transparency completely into the slide mount as the slide mount is being advanced away from the film insertion and severing station.

SUMMARY OF THE INVENTION

The slide mounting apparatus of the present invention is an improvement to slide mounters of the type in which a leading end of a photograhic web is partially inserted into a slide frame, a transparency is cut from the film web, and the severed film transparency is then engaged and fully inserted into the slide frame. The present invention is based upon the recognition that photographic film typically has a curl or bow due to the presence of an emulsion layer on one side of the film. This curl can cause the leading edge of the transparency to hang up and prevent full insertion of the transparency into the slide frame. In the apparatus of the present invention, the slide frame is bowed by an amount sufficient to match the curl or bow of the transparency as the transparency is fully inserted in the slide frame.

DETAILED DESCRIPTION OF THE PREFERRED EMBODIMENTS

Figure 1:
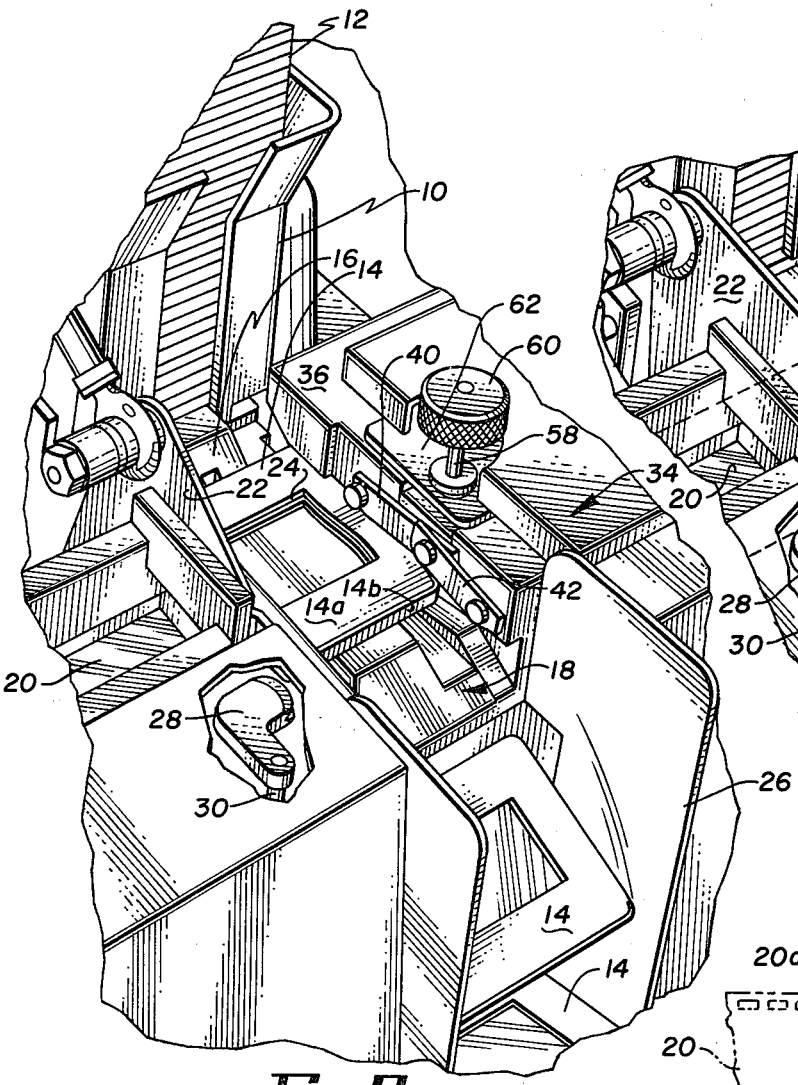
FIGS. 1 through 3 are perspective views of a preferred embodiment of the photographic slide mounter of the present invention at various stages in an operating cycle.
Figure 2:
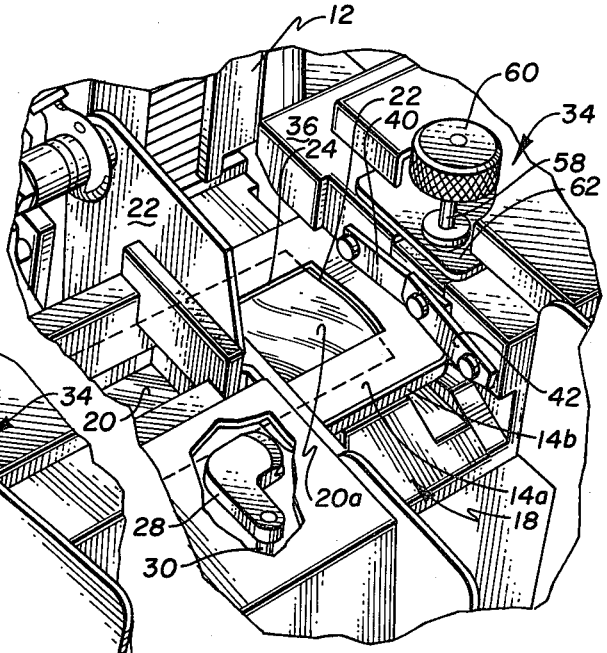
Figure 3:
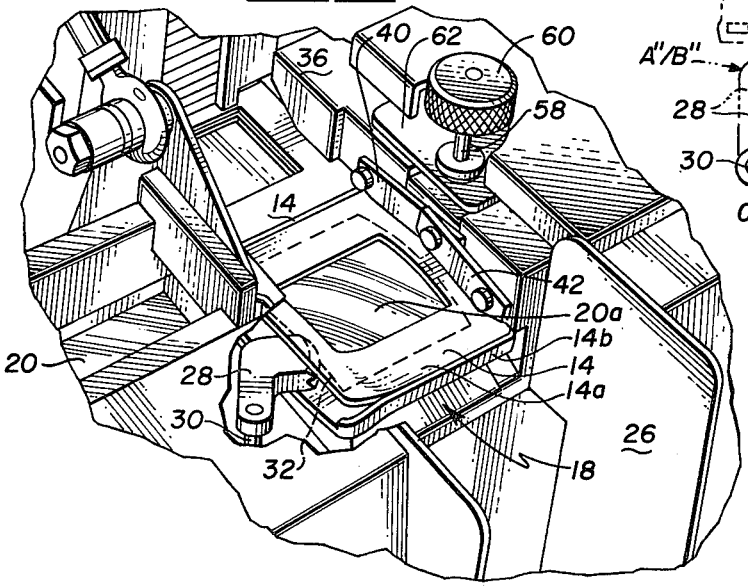

In FIGS. 1–3, an operating cycle of a photographic slide mounter utilizing the present invention is illustrated. Slide magazine 10 contains stack 12 of photographic slide mounts 14, which are preferably Pakon slide mounts.

During each operating cycle, lowermost slide mount 14 in magazine 10 is ejected by ejector 16, and is pushed along slide track 18. As slide mount 14 is ejected from magazine 10 by ejector 16 and pushed to the position illustrated in FIG. 1, cover portion **14*a* and base portion 14*b* of mount 14 are separated along one edge to create an insertion opening into which a leading end of the film web 20** is inserted.

After slide mount 14 is in a position to receive film web 20, slide ejector 16 is retracted, movable knife blade 22 is lifted, and film web 20 is advanced through the insertion opening into slide mount 14, as illustrated in FIG. 2. Once film web 20 has been advanced so that the desired location for severing transparency **20*a* from web 20 is aligned with knife blade 22, advancement of web 20 is stopped. Movable blade 22 is then driven downward to sever transparency 20*a* from the remainder of web 20. Since the severing of transparency 20*a* from web 20 occurs outside of slide mount 14, transparency 20*a* is not yet fully inserted into slide mount 14. As illustrated in FIG. 2, leading edge 22 of transparency 20*a* is visible through aperture 24 in slide mount 14. The insertion of transparency 20*a* the remaining distance into slide mount 14 is achieved during the next portion of the operating cycle which is illustrated in FIG. 3. In this portion of the cycle, ejector 16 begins to push the next slide mount 14' out through the bottom of magazine 10 and into slide track 18. Slide mount 14' pushes previous slide mount 14 along track 18 toward collecting basket 26. As slide mount 14 advances away from the film inserting and cutting station, film insertion lever 28 is pivoted about shaft 30 to engage trailing edge 32 of transparency 20***a* and push transparency 20*a* the remaining distance into slide mount 14. FIGS. 1 and 2 are broken away to illustrate the normal position of insertion lever 28, and FIG. 3 is broken away to illustrate the actuated position of lever 28 as it drives transparency 28 the remaining distance into slide mount 14.

Figure 4:
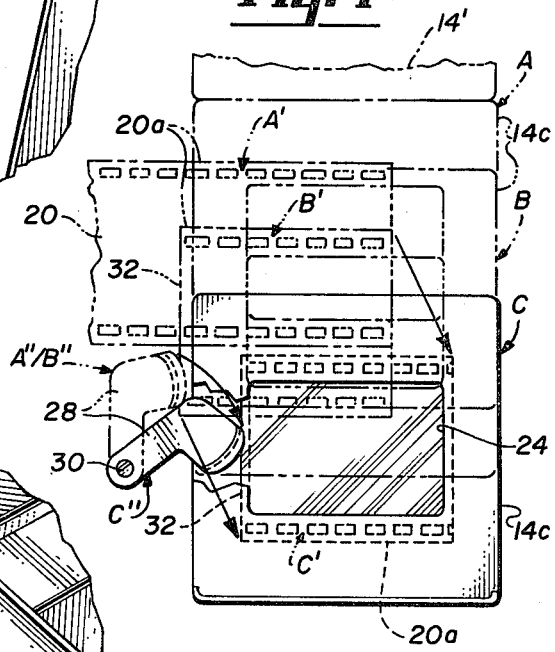
FIG. 4 is a diagram illustrating operation of the slide mounter of FIGS. 1–3 at three different stages during an operating cycle.

The operation of insertion lever 28 is further illustrated in FIG. 4, which shows slide mount 14, transparency 20*a*, and insertion lever 28 at three different positions. The three positions of slide mount 14 are labeled A, B and C; the three corresponding positions of transparency 20*a* are labeled A′, B′, and C′; and the three corresponding positions of insertion lever 28 are labeled A″, B″ and C″.

As illustrated in FIG. 4, in position A slide mount 14 is receiving the leading end of film web 20, which includes transparency 20*a*. Position A′ is the position of transparency 20*a* when web 20 has completed advancement into slide mount 14, but has not yet been cut by knife 22. After transparency 20*a* has been severed from web 20 slide mount 14 begins to be pushed by the next slide mount 14′, as illustrated in FIG. 3. As slide mount 14 reaches position B, insertion lever 28 engages trailing edge 32 of transparency 20*a*, and being to pivot about shaft 30 to drive transparency 20*a* the remaining distance into slide mount 14, so that the scene contained in transparency 20*a* is properly aligned with aperture 24. The pivoting of insertion lever 28 from position B″ to position C″ occurs as slide mount 14 continues to be driven from position B to position C. Once insertion lever 28 reaches position C″, it is retracted to its normal rest position out of the path of slide mount 14.

Figure 5:
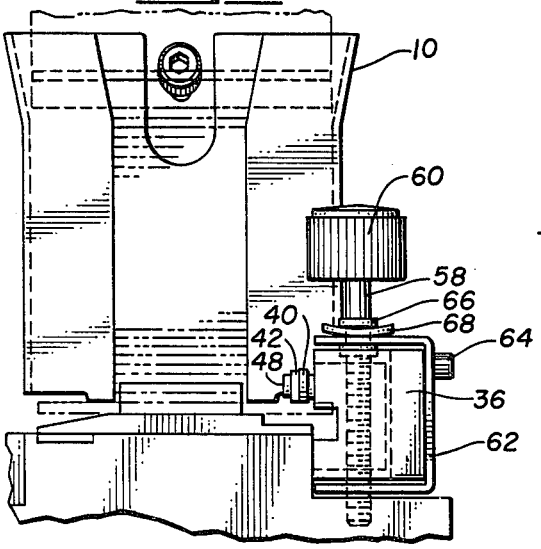
FIG. 5 is an end view of the curl accommodator of the slide mounter of FIGS. 1–3.
Figure 6A:
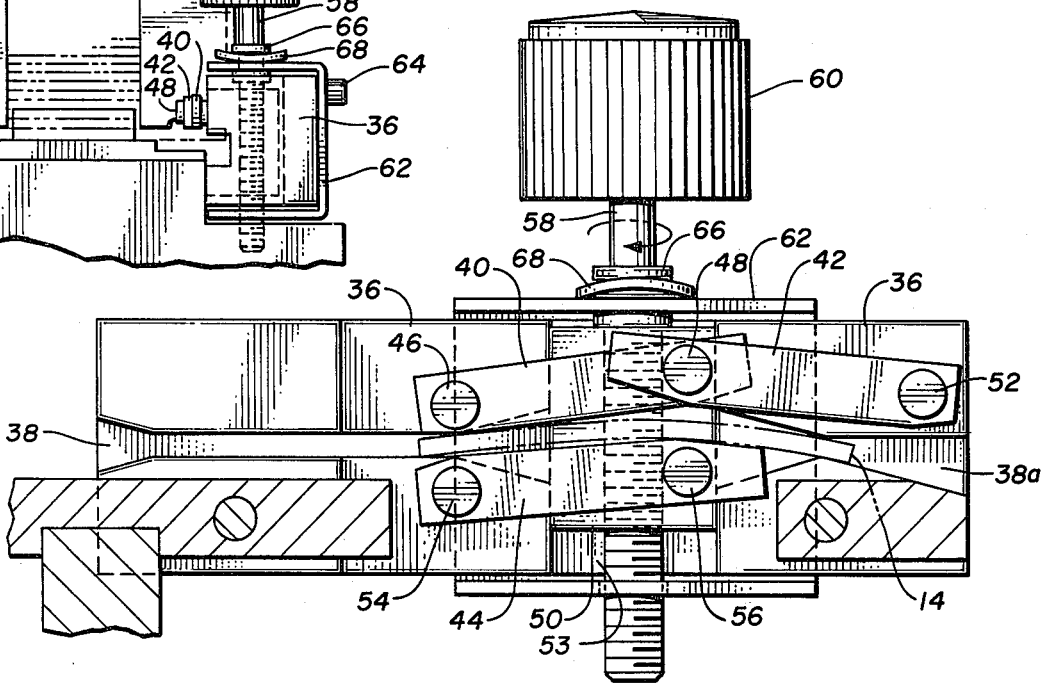
FIGS. 6A and 6B are side views illustrating the operation of the curl accommodator.
Figure 6B:
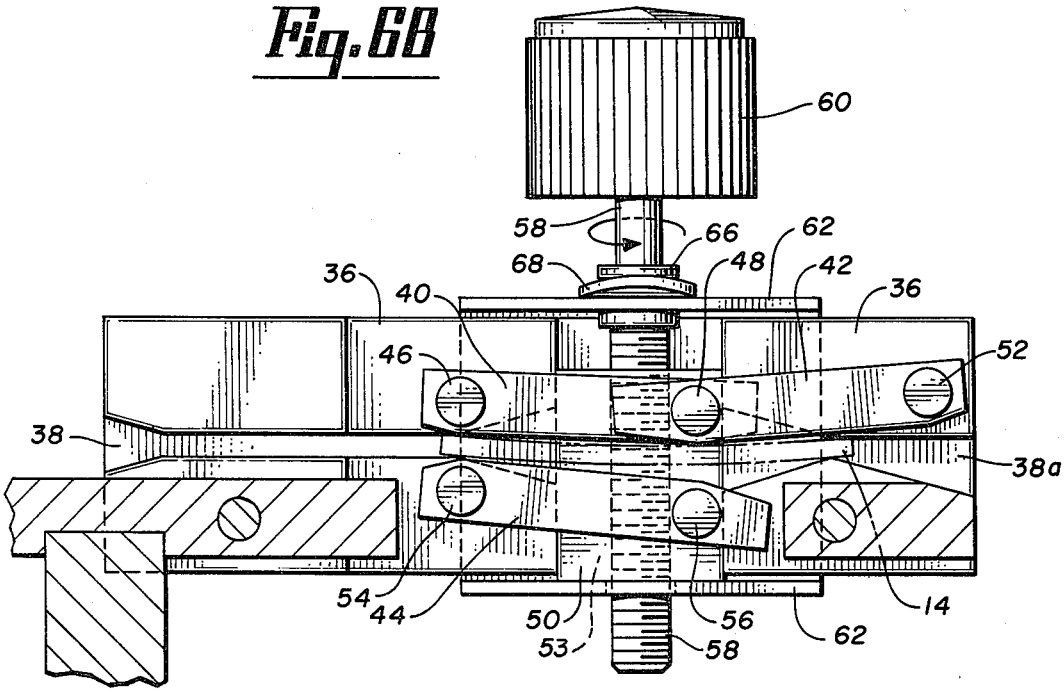

The slide mounter of the present invention further includes curl accommodator apparatus 34, which is illustrated in FIGS. 1–3, and in further detail in FIGS. 5, 6A, and 6B. Curl accommodator 34 bows slide mount 14 in a direction transverse to the movement of transparency 22 as film insertion lever 28 drives transparency 20*a* the remaining distance into slide mount 14.

Photograhic film 20 and transparency 20*a* typically has photographic emulsion layers on one side. As a result, film 20 and transparency 20*a* exhibit a transverse bow or curve which is concave on the side having the emulsion layers. This curl or bow can cause leading edge 22 of transparency 20 to catch or hang up on an edge of aperture 24 as insertion lever 28 attempts to drive transparency 20*a* the remaining distance to slide mount 14. This can result in improper alignment of transparency 20 with respect to aperture 24, and in some cases can damage transparency 20*a*.

Curl accommodator 34 of the present invention permits the operator of the slide mounter to bow slide mount 14 so as to match the curl or bow in transparency 20*a*. As a result, leading edge 22 of transparency 20*a* has a bow which matches that of slide mount 14, and passes the edge of aperture 24 without hanging up.

In the embodiments of the present invention illustrated in the Figures, curl accommodator 34 includes mounting block 36 which is positioned along one edge of slide track 18. Mounting block 36 provides guide tracks 38 and 38*a* for edge 14*c* of slide mount 14. The bowing of slide mount 14 is provided by upper arms 40 and 42 and lower arm 44, which form a variable bow guide track between guide tracks 38 and 38*a*. One end of upper arm 40 is pivotally connected to mouting block 36 by pivot pin 46, and the opposite end of arm 40 is pivotally connected by pivot pin 48 to movable deflector block 50. Upper arm 42 is pivotally connected at one end to mounting block 36 by pivot pin 52, and is pivotally connected at its opposite end by pivot pin 48 to movable deflector block 50. Lower arm 44 is pivotally connected at one end to mounting block 36 by pivot pin 54 and is pivotally connected to movable deflector block 50 by pivot pin 56.

Movable deflector block 50 is positioned in recess 53 within mounting block 36, and is movable in a vertical direction by adjusting screw 58. As best illustrated in FIGS. 6A and 6B, adjusting screw 58 is threaded through block 50, so that rotation of screw 58 in one direction (by turning adjusting knob 60) causes block 50 to move upward, and rotation of adjusting knob 60 and screw 58 in the opposite direction causes block 50 to move downward. Adjusting screw 58 is mounted by means of mounting bracket 62, which is connected to mounting block 36 by screws 64. Retaining rings 66 and curved spring washer 68 hold screw 58 in position with respect to brackets 62.

As illustrated in FIG. 6A, when movable block 50 is in its uppermost position, pivot pin 48 is at an elevation above pivot pins 46 and 52. Similarly, pivot pin 56 is at an elevation above pivot pin 54. As a result, the center of slide mount 14 is pressed upward by lower arm 44, thereby causing a concave down bow of slide mount 14. This is useful when transparency 20*a* has its emulsion side down, so that transparency 20*a* is also bowed in a concave down fashion.

As illustrated in FIG. 6B, when movable block 50 is in its lowermost position, the trailing ends of top arm 40 and the leading end of top arm 42 press downward on the center portion of slide mount 14 as it is advanced from guide slot 38 to guide slot 38*a*. This is because movable block 50 has moved pivot pin 48 to an elevation which is below pivot pins 46 and 52. Similarly, movable block 50 has moved pivot pin 56 to an elevation below pivot pin 54, so that the leading end of lower arm 44 applies an upward force to the trailing edge of slide 14. The effect is a concave up bowing of slide mount 14. This is useful when transparency 20*a* has its emulsion side up, so that transparency 20*a* is also bowed in a concave up fashion.

It should also be noted that the leading and trailing edges of arms 40, 42 and 44 are beveled. As illustrated in FIGS. 6A and 6B, these beveled surfaces permit slide mount 14 to move from guide track 38 to between arms 40 and 44 smoothly without hanging up on a sharp corner, regardless of the position of arms 40 and 44. Similarly, the tapers of arms 40, 42 and 44 permit a smooth transition of slide mount 14 from between arms 40, 42 and 44 to track 38*a*, regardless of the positions of arms 40, 42 and 44.

In conclusion, the curl accommodator of the present invention provides a simple adjustable device for accommodating and adjusting for the film curl which is typically present in photograhic film transparencies being mounted in slide mounts. The curl accommodator prevents misalignment and possible damage to film transparencies which can otherwise be caused by the natural tendency of the film transparencies to curl.

Although the present invention has been described with reference to preferred embodiments, workers skilled in the art will recognize that changes may be made in form and detail without departing from the spirit and scope of the invention.

What is claimed is:

1. Apparatus for mounting a film transparency in a slide mount, said slide mount having opposing portions defining a plane therebetween, the apparatus comprising:

means for partially inserting a film transparency, while attached to a film web, into the slide mount;

means for severing the transparency from the web at a position outside the slide mount;

means for engaging the transparency to fully insert the transparency into the slidemount; and means for bowing both portions of the slide mount in the same direction relative to said plane about an axis parallel to the direction of transparency insertion to match a curl in the transparency as the transparency is fully inserted into the slide mount.

2. The apparatus of claim 1 and further comprising:

a slide track having an insertion station at which the transparency is partially inserted into the slide mount;

means for moving the slide mount with the partially inserted transparency along the slide track away from the insertion station;

wherein the means for engaging the transparency engages and fully inserts the transparency into the slide mount as the slide mount is moved along the slide track away from the insertion station; and wherein the means for bowing the slide mount bows the slide mount as the slide mount is moved along the slide track away from the insertion station.

3. The apparatus of claim 2 wherein the slide mount has first and second opposite edges, the first edge having an insertion opening through which the film transparency is inserted into the slide mount.

4. The apparatus of claim 3 wherein the means for bowing the slide mount engages the second edge of the slide mount to bow the slide mount.

5. The apparatus of claim 4 wherein the means for bowing comprises an edge guide track generally parallel to the slide track for engaging and guiding the second edge of the slide mount, the edge guide track having a bowed section which causes the second edge of the slide mount to be bowed.

6. The apparatus of claim 5 wherein the edge guide track has first and second essentially straight guide sections, and wherein the bowed section is intermediate the first and second section.

7. The apparatus of claim 6 and further comprising means for varying the bow of the bowed section of the edge guide track.

8. The apparatus of claim 7 wherein the bowed section of the edge guide track comprises upper and lower guide arms extending along the edge guide track, the guide arms being pivotally connected at one end to a fixed member and pivotally connected at an opposite end to a movable member, and wherein the means for varying the bow of the bowed section comprises means for varying the position of the movable member with respect to the fixed member.

9. The apparatus of claim 8 wherein the movable member is movable in a direction essentially orthogonal to the direction of travel of a slide mount along the edge guide track.

10. The apparatus of claim 9 wherein the means for adjusting the position of the movable member comprises an adjustment screw.

11. Apparatus for mounting a film transparency in a slide mount of a type having two portions which can be flexed apart to provide an insertion opening at a first edge thereof, said two portions defining a plane therebetween, the apparatus comprising:

means for bringing the slide mount to a film insertion station;

means for flexing the slide mount to cause the slide mount to provide the insertion opening when positioned at the film insertion station;

means for advancing a film web to the film insertion station until a leading end of the film web including the film transparency is partially inserted in the slide mount through the insertion opening;

means for severing the film transparency from the leading end of the film web so that a portion of the severed transparency remains protruding from the slide mount through the insertion opening;

means for feeding the slide mount with partially inserted transparency along a track away from the film insertion station;

means for engaging the transparency and fully inserting the transparency into the slide mount as the slide mount and transparency are fed along the track; and means for bowing both portions of the slide mount in the same direction relative to said plane about an axis parallel transverse to the direction of transparency insertion by an amount sufficient to match a curl of the transparency as the transparency is fully inserted in the slide mount.

12. The apparatus of claim 11 wherein the slide mount has a second edge opposite the first edge, and wherein the means for bowing the slide mount engages the second edge of the slide mount to bow the slide mount as the transparency is fully inserted in the slide mount.

13. The apparatus of claim 12 wherein the means for bowing comprises an edge guide track for engaging and guiding the second edge of the slide mount, the edge guide track having a bowed section which causes the second edge of the slide mount to be bowed.

14. The apparatus of claim 13 wherein the means for bowing the slide mount further comprises means for varying the bow of the bowed section of the edge guide track.

15. Apparatus for mounting a film transparency in a slide mount, said slide mount having opposing portions defining a plane therebetween, the apparatus comprising:

a slide track along which the slide mount is advanced;

a film track generally orthogonal to the slide track and intersecting the slide track at a film insertion station;

means for advancing the slide mount along the slide track to the film insertion station;

means for advancing a film web along the film track and into the slide mount at the film insertion station, so that a film transparency attached to the film web is partially inserted into the slide mount;

means for severing the film transparency from the film web;

means for advancing the slide mount with partially inserted transparency along the slide track away from the film insertion station;

means for engaging the transparency to fully insert the transparency into the slide mount as the slide mount and transparency are moved along the slide track away from the film insertion station; and means for bowing both portions of the slide mount in the same direction relative to said plane about an axis parallel to the direction of transparency insertion as the transparency is fully inserted into the slide mount.

16. The apparatus of claim 15 wherein the means for bowing the slide mount includes means for adjusting the amount of bowing of the slide mount.

* * * * *